US010475424B2

(12) United States Patent
Motohashi et al.

(10) Patent No.: US 10,475,424 B2
(45) Date of Patent: Nov. 12, 2019

(54) ELECTRONIC DRUM PAD

(71) Applicants: KORG INC., Tokyo (JP); Pearl Musical Instrument Co., Chiba (JP)

(72) Inventors: Haruhiko Motohashi, Tokyo (JP); Tatsuya Nishikawa, Tokyo (JP); Akito Takegawa, Chiba (JP)

(73) Assignees: KORG, INC., Tokyo (JP); PEARL MUSICAL INSTRUMENT CO., Chiba (JP)

( * ) Notice: Subject to any disclaimer, the term of this patent is extended or adjusted under 35 U.S.C. 154(b) by 0 days.

(21) Appl. No.: 16/236,846

(22) Filed: Dec. 31, 2018

(65) Prior Publication Data

US 2019/0213983 A1 Jul. 11, 2019

(30) Foreign Application Priority Data

Jan. 11, 2018 (JP) ..... 2018-002701

(51) Int. Cl.

| | |
|---|---|
| ***G10H 1/32*** | (2006.01) |
| ***G10H 3/00*** | (2006.01) |
| ***G10D 13/02*** | (2006.01) |
| ***G10H 3/12*** | (2006.01) |

(52) U.S. Cl.

CPC ..... *G10D 13/024* (2013.01); *G10D 13/027* (2013.01); *G10H 1/32* (2013.01); *G10H 3/12* (2013.01)

(58) Field of Classification Search

CPC ..... G10D 13/024; G10H 1/32; G10H 3/12
USPC ..... 84/743
See application file for complete search history.

(56) References Cited

U.S. PATENT DOCUMENTS 5,854,436 A * 12/1998 Wernick ..... G10H 3/146 84/411 P
6,121,538 A * 9/2000 Yoshino ..... G10D 13/024 84/414
6,326,539 B1 * 12/2001 Mishima ..... G10H 3/14 36/139
6,525,249 B1 * 2/2003 Suenaga ..... G10D 13/022 84/104
7,439,432 B2 * 10/2008 Hiraku ..... G10D 13/024 84/411 P
8,841,527 B2 * 9/2014 Shih ..... G10H 1/32 84/104
8,884,151 B1 * 11/2014 Lee ..... G10H 3/146 84/464 R (Continued)

OTHER PUBLICATIONS

Alesis, "Crimson Mesh Kit: Five-Piece Electronic Drum Kit with Mesh Heads," Jun. 2014.

*Primary Examiner* — Jeffrey Donels
(74) *Attorney, Agent, or Firm* — Greenblum & Bernstein, P.L.C.

(57) ABSTRACT

An electronic drum pad includes a drum shell; a mesh head stretched at the upper opening of the drum shell; a hard-resin sheet disposed adjacent to the rear surface of the mesh head and having a ring shape with an opening made at a center thereof; a cloth disposed adjacent to the rear surface of the hard-resin sheet; a strike absorbing member disposed adjacent to the rear surface of the cloth and formed by overlaying a plurality of sheets; and a tray disposed adjacent to the rear surface of the strike absorbing member and fitted into the lower opening of the drum shell.

14 Claims, 7 Drawing Sheets

(56) References Cited

U.S. PATENT DOCUMENTS

| | | | | |
|---|---|---|---|---|
| 8,933,315 | B2 * | 1/2015 | Marquez | G10H 1/0558 84/104 |
| 9,099,070 | B2 * | 8/2015 | Shih | G10H 3/12 |
| 9,424,827 | B2 | 8/2016 | Gill et al. | |
| 2004/0149120 | A1 * | 8/2004 | Maruhashi | G10D 13/024 84/411 R |
| 2005/0022655 | A1 * | 2/2005 | Wise | G10H 3/146 84/743 |

* cited by examiner level
frequency
1st row
2nd row
3rd row

ELECTRONIC DRUM PAD

TECHNICAL FIELD

The present invention relates to an electronic drum pad.

BACKGROUND ART

A conventional example of an electronic drum pad is described, for example, in Non-Patent Literature 1. The electronic drum pad described in Non-Patent Literature 1 employs a mesh head. The mesh head is made of a net-like fabric woven with special threads. Since air passes through the net lattice, it is difficult for air vibrations to occur when the drum pad is struck, and the pad has superior low-noise characteristics (Non-Patent Literature 1).

Non-Patent Literature 1: ALESIS, "CRIMSON MESH KIT, Five-Piece Electronic Drum Kit with Mesh Heads", online, retrieved on Nov. 30, 2017, Internet URL: https://www.alesis.com/products/view2/crimson-mesh-kit The sense of striking, however, is sometimes different between electronic drum pads that employ a mesh head and acoustic drums. When the mesh head is struck, for example, rebounding of the drumsticks is larger than that with acoustic drums. Therefore, it may be difficult to allow stick rebound on acoustic drums to be reproduced well.

In addition, when a strike is applied to a peripheral area of the head of an acoustic drum, a sense of hard striking is obtained; when a strike is applied to a center area of the head, a sense of soft striking is obtained. It may be difficult to allow different senses of striking depending on the strike positions of the head of an acoustic drum to be reproduced well in a conventional electronic drum pad having a mesh head.

SUMMARY OF THE INVENTION

An object of the present invention is to provide an electronic drum pad that can successfully reproduce the sense of striking obtained at acoustic drums.

An electronic drum pad according to the present invention includes a drum shell; a mesh head stretched at an upper opening of the drum shell; a hard-resin sheet disposed adjacent to a rear surface of the mesh head and having a ring shape with an opening made at a center thereof; a cloth disposed adjacent to a rear surface of the hard-resin sheet; a strike absorbing member disposed adjacent to a rear surface of the cloth and formed by overlaying a plurality of sheets; and a tray disposed adjacent to a rear surface of the strike absorbing member and fitted into a lower opening of the drum shell.

Effects of the Invention

According to an electronic drum pad of the present invention, the sense of striking obtained at acoustic drums can be reproduced successfully.

BRIEF DESCRIPTION OF THE DRAWINGS

FIG. 1A is a plan thereof; FIG. 1B is a front view thereof;

FIG. 3A is an outline cross-sectional view of the electronic drum pad; FIG. 3B is an outline cross-sectional view of an edge-sensor assembly;

FIG. 5A is a plan thereof; FIG. 5B is a front view thereof;

DETAILED DESCRIPTION

Embodiments of the present invention will be described below in detail.

First Embodiment

Figure 1A:
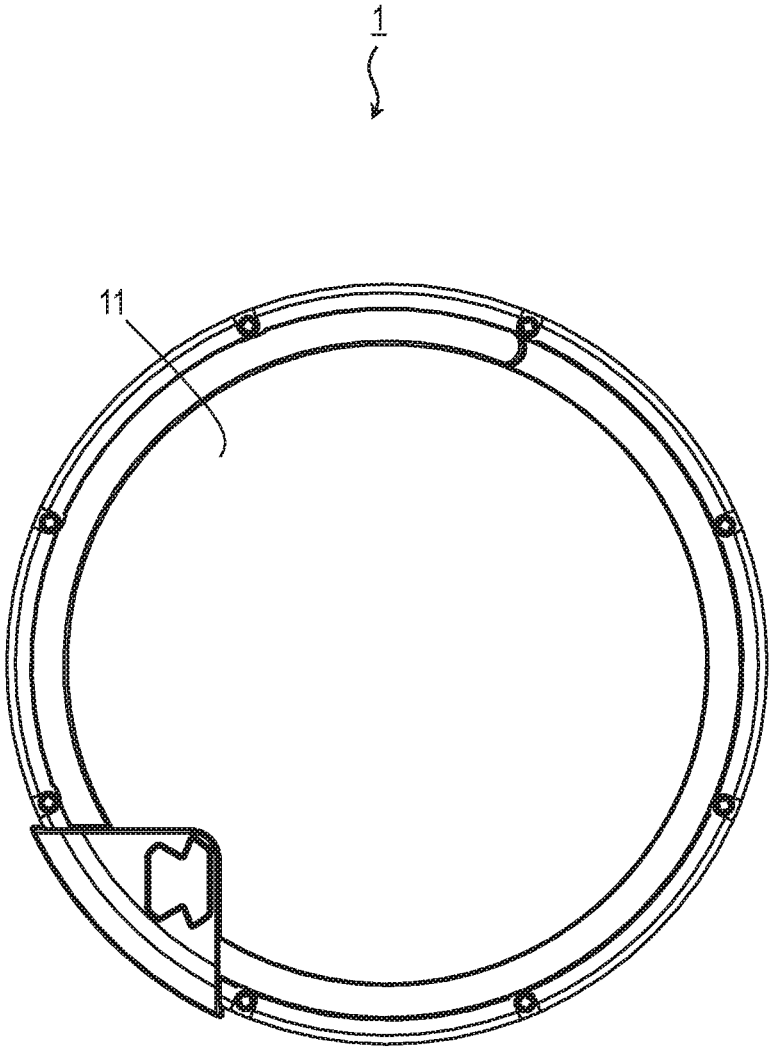
FIG. 1A and FIG. 1B are views showing an electronic drum pad according to a first embodiment.
Figure 1B:
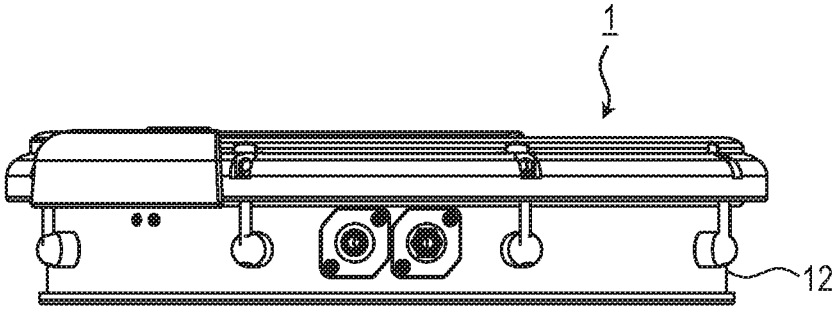

The external shape of an electronic drum pad 1 according to a first embodiment will be described below by referring to FIG. 1A and FIG. 1B. The electronic drum pad 1 of the present embodiment imitates a snare drum. As shown in the figures, the electronic drum pad 1 is shallow and almost cylindrical and includes a drum shell 12 having an upper opening and a lower opening and a mesh head 11 stretched at the upper opening of the drum shell 12.

Figure 2:
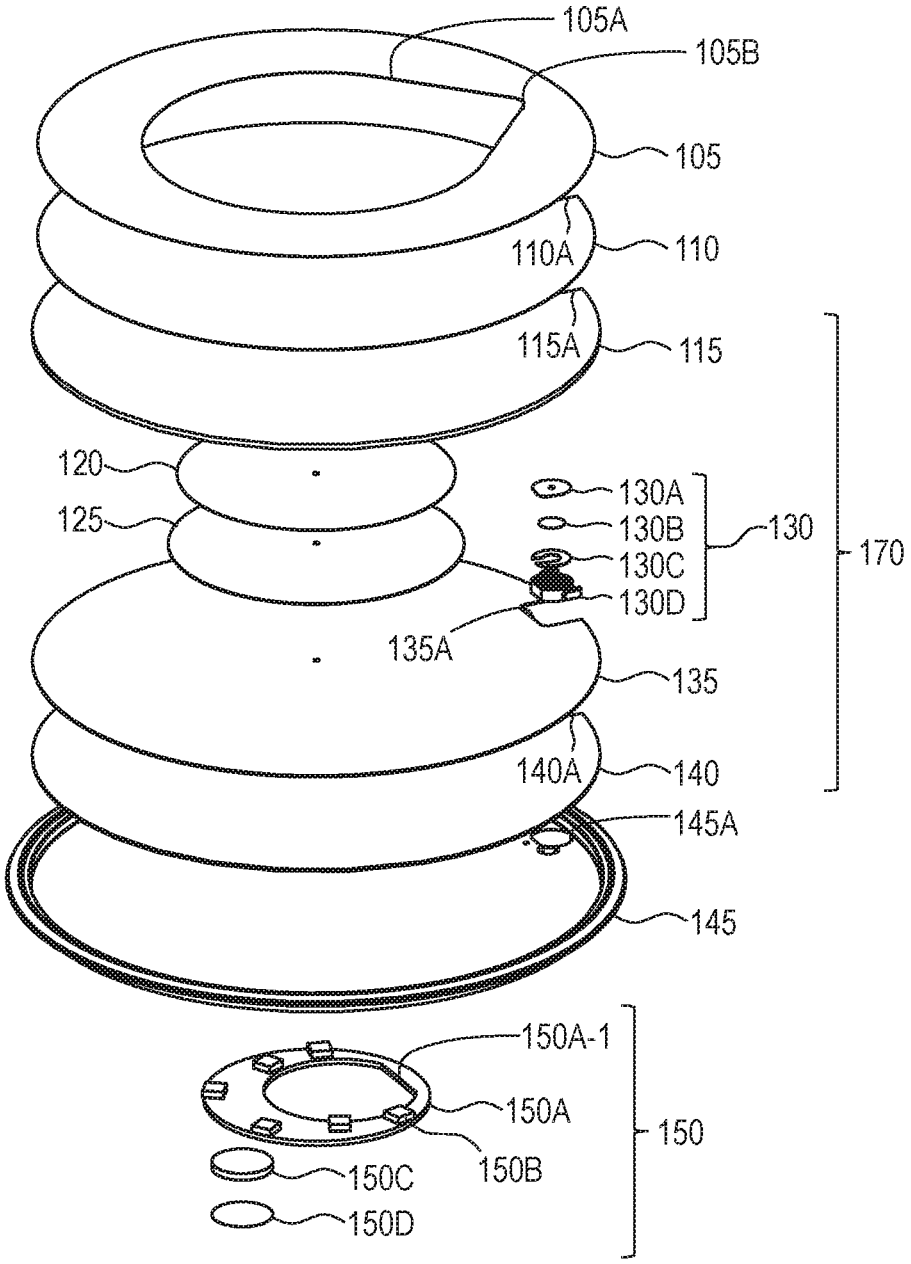
FIG. 2 is an exploded, perspective view of the parts other than a mesh head and a drum shell in the electronic drum pad according to the first embodiment.
Figure 3A:
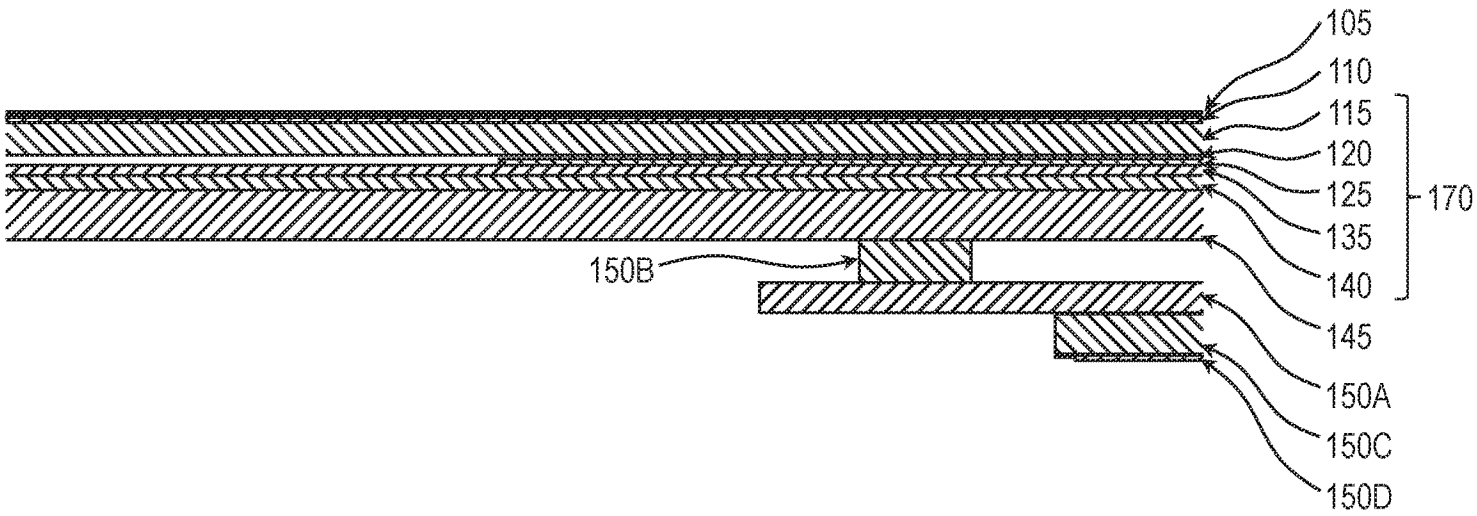
FIG. 3A and FIG. 3B are outline cross-sectional views of the electronic drum pad according to the first embodiment.
Figure 3B:
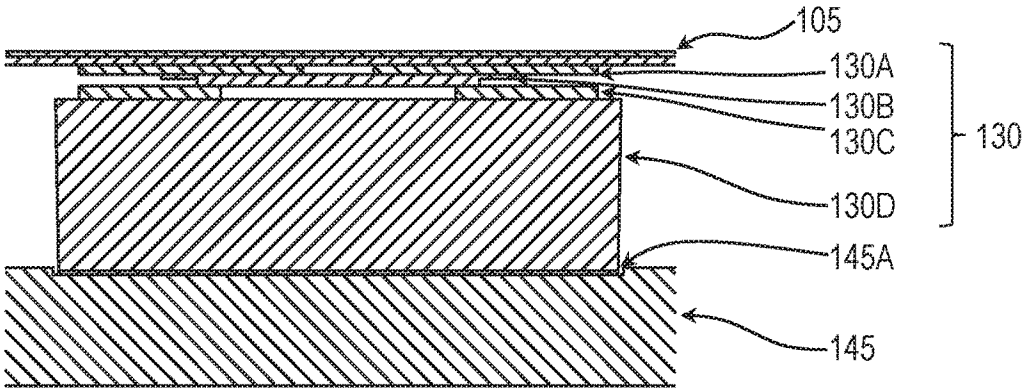

The internal structure of the electronic drum pad 1 according to the present embodiment will be described below by referring to FIG. 2, FIG. 3A, and FIG. 3B. As shown in FIG. 2 and FIG. 3A, the electronic drum pad 1 internally includes a first hard-resin sheet 105 having a circular, thin, flat, ring shape, disposed adjacent to the rear surface of the mesh head 11, and having an opening 105A at a center thereof; a cloth 110 disposed adjacent to the rear surface of the first hard-resin sheet 105; a strike absorbing member 170 disposed adjacent to the rear surface of the cloth 110 and formed by overlaying a plurality of sheets (115, 120, 125, 135, and 140); a tray 145 disposed adjacent to the rear surface of the strike absorbing member 170 and fitted into the lower opening of the drum shell 12; an edge-sensor assembly 130 provided at a position close to an inner wall of the drum shell 12; and a center-sensor assembly 150 secured to the rear surface of the tray 145.

First Hard-Resin Sheet 105

The first hard-resin sheet 105 is a circular, thin, ring shaped sheet having the opening 105A, which is almost circular, at a center thereof. The opening 105A includes a cut 105B made partially toward the outside. The cut 105B is made to transfer high-pitched sound successfully to an edge sensor 130B, to be described later, when a strike is applied to a peripheral area of the head 11. Any hard resin can be used for the first hard-resin sheet 105. It is preferable to use polyethylene terephthalate (PET), for example. Other materials that can be used for the sheet 105 include high-density polyethylene (HDPE), hard polyvinyl chloride (PVC), polycarbonate (PC), acrylic (PMMA), and polypropylene (PP).

Since the first hard-resin sheet 105 is made of a hard resin, the electronic drum pad 1 can give a player a sense of hard striking when a peripheral area of the head 11, where the first hard-resin sheet 105 is positioned, is struck. In addition, since the opening 105A is made at a center area of the first hard-resin sheet 105, the electronic drum pad 1 can give a player a sense of non-hard striking when a center area of the head 11, where the opening 105A is positioned, is struck. Consequently, the sense of striking obtained on the electronic drum pad 1 is made close to that obtained on acoustic drums.

Cloth 110

The cloth 110 is a circular thin sheet having almost the same size as the first hard-resin sheet 105 and includes a cut 110A made inward at a part of the perimeter thereof. It is preferable to use a nonwoven fabric for the cloth 110. The cloth 110 is inserted between the first hard-resin sheet 105 and a porous resin sheet 115, to be described later, to prevent the generation of a hitting sound by these sheets when the electronic drum pad 1 is struck. In other words, the cloth 110 serves as a cushioning member (impact absorbing member) between the first hard-resin sheet 105 and the porous resin sheet 115.

Strike Absorbing Member 170

The strike absorbing member 170 suitably absorbs a strike mainly when the strike is applied to a center area of the mesh head 11, to adjust the sense of striking to a level neither too soft nor too hard to make the sense of striking close to that of acoustic drums when a center area of the head thereof is struck.

The strike absorbing member 170 is made by overlaying at least, sequentially from the mesh head 11, the porous resin sheet 115, a first rubber sheet 135, and a resin emulsion sheet 140. The strike absorbing member 170 further includes a second hard-resin sheet 120 and a second rubber sheet 125 inserted, sequentially from the mesh head 11 side, between the porous resin sheet 115 and the first rubber sheet 135.

Tray 145

The tray 145 has a circular dish shape and a raised rim surrounding at the perimeter thereof, and also includes a shallow indentation 145A close to the periphery of the tray 145. The tray 145 can be secured by being fitted into (caught at) the lower opening of the drum shell 12. Any hard strong resin can be used for the tray 145. It is preferable to use polycarbonate (PC), for example. Other materials that can be used for the tray 145 include polyethylene terephthalate (PET), high-density polyethylene (HDPE), hard polyvinyl chloride (PVC), acrylic (PMMA), and polypropylene (PP).

Porous Resin Sheet 115

The porous resin sheet 115 is a circular thin sheet having almost the same size as the first hard-resin sheet 105 and includes a cut 115A made inward at a part of the perimeter thereof. A porous resin material (soft resin or expanded resin having an extremely large number of fine holes inside) should be used for the porous resin sheet 115. It is preferable to use an ethylene propylene rubber (EPDM rubber sponge) for the porous resin sheet 115, for example. Other materials that can be used for the porous resin sheet 115 include natural rubber (NR sponge), a chloroprene rubber (CR sponge), a nitrile rubber (NBR sponge), a silicone rubber (Si rubber sponge), and a styrene-butadiene rubber (SBR sponge).

Since the porous resin sheet 115 is made of a porous resin, the electronic drum pad 1 is made to give a sense of striking close to the sense of soft striking obtained when a center area of the head of an acoustic drum is struck, and, at the same time, to enhance the low-noise characteristics.

First Rubber Sheet 135

The first rubber sheet 135 is a circular thin sheet having almost the same size as the first hard-resin sheet 105 and includes a cut 135A made inward at a part of the perimeter thereof. An elastic rubber should be used as the material for the first rubber sheet 135. It is preferable to use a chloroprene rubber (CR) for the first rubber sheet 135, for example. Other materials that can be used for the first rubber sheet 135 include a styrene-butadiene rubber (SBR), an isoprene rubber (IR), a butadiene rubber (BR), and an acrylonitrile butadiene rubber (NBR). A non-diene system synthetic rubber may be used, such as an isobutylene-isoprene rubber (IIR), an ethylene propylene rubber (EPM), an ethylene propylene rubber (EPDM), a silicone rubber (Si, Q), or a fluororubber (FKM).

Since the first rubber sheet 135 is made of an elastic rubber, a sense of hard striking is added to the sense of striking that becomes too soft due to the porous resin sheet 115, and the electronic drum pad 1 is made to give a sense of striking close to that obtained when a center area of the head of an acoustic drum is struck.

Resin Emulsion Sheet 140

The resin emulsion sheet 140 is a circular thin sheet having almost the same size as the first hard-resin sheet 105 and includes a cut 140A made inward at a part of the perimeter thereof. An acrylic resin emulsion should be used as the material for the resin emulsion sheet 140. The resin emulsion sheet 140 is bonded to the tray 145.

Since the resin emulsion sheet 140 is made of a resin emulsion (aqueous resin) and the resin emulsion sheet 140 is bonded to the tray 145, reverberation generated at the tray 145 when a strike is made is suppressed. The reverberation generated at the tray 145 causes noise in trigger detection at a center sensor 150D, to be described later, and makes the sound of a strike large. Since the resin emulsion sheet 140 is employed, the causes of noise in trigger detection are reduced and the low-noise characteristics are enhanced.

Second Hard-Resin Sheet 120

The second hard-resin sheet 120 is a circular thin sheet and is made smaller than the opening 105A of the first hard-resin sheet 105. The second hard-resin sheet 120 is disposed at a position where the shape made by projecting the second hard-resin sheet 120 from above is included in the shape made by projecting the opening 105A from above. The material used for the second hard-resin sheet 120 is the same as that for the first hard-resin sheet 105.

Second Rubber Sheet 125

The second rubber sheet 125 is a circular thin sheet and is made smaller than the opening 105A of the first hard-resin sheet 105. The second rubber sheet 125 is disposed at a position where the shape made by projecting the second rubber sheet 125 from above is included in the shape made by projecting the opening 105A from above. The material used for the second rubber sheet 125 is the same as that for the first rubber sheet 135.

Since the second hard-resin sheet 120 and the second rubber sheet 125 are made to have the sizes described above and are disposed at the positions described above, a sense of hard striking is added to the sense of striking at the center area, and the electronic drum pad 1 is made to have a sense of striking closer to that obtained when a center area of the head of an acoustic drum is struck. Since the second hard-resin sheet 120 and the second rubber sheet 125 are made to have the sizes described above and are disposed at the positions described above, center areas of the porous resin sheet 115 and the cloth 110 rise upward slightly. The opening 105A of the first hard-resin sheet 105 is fitted into these raised portions, making the first hard-resin sheet 105 closely contact with the cloth 110 for stable positioning.

Consequently, the first hard-resin sheet 105 is prevented from rising, thus neither generating noise nor degrading the sense of striking.

Edge-Sensor Assembly 130

As shown in FIG. 2, the electronic drum pad 1 includes the edge-sensor assembly 130 at a position close to the inner wall of the drum shell 12. The edge-sensor assembly 130 is accommodated in a vacant space produced when the cuts 110A, 115A, 135A, and 140A, described before, are overlaid. As shown in FIG. 2 and FIG. 3B, the edge-sensor assembly 130 includes a first cushion member 130A contacting with the rear surface of the first hard-resin sheet 105; the edge sensor 130B, which contacts with the rear surface of the first cushion member 130A; a second cushion member 130C contacting with the rear surface of the edge sensor 130B; and a pedestal 130D contacting with the rear surface of the second cushion member 130C and being fitted into the indentation 145A on the front surface of the tray 145. The materials for the first cushion member 130A and the second cushion member 130C should be urethane foam, for example.

The edge sensor 130B mainly detects high-pitched sound produced when a peripheral area of the electronic drum pad 1 is struck. The edge sensor 130B should be a piezoelectric device, for example. As described above, since the edge-sensor assembly 130 is sandwiched from above and below by the first hard-resin sheet 105 and the tray 145 to be fixed, high-pitched sound is detected successfully.

Center-Sensor Assembly 150

The center-sensor assembly 150 is secured to the rear surface of the tray 145. The center-sensor assembly 150 includes a plate 150A bonded to a center of the rear surface of the tray 145 via first porous members 150B and having a hole 150A-1 at a center thereof and a ring shape, and a center sensor 150D bonded to the rear surface of the plate 150A via a second porous member 150C. The center sensor 150D is bonded at a position other than that of the hole 150A-1. The materials for the first porous members 150B and the second porous member 150C should be urethane foam, for example.

The center sensor 150D mainly detects a strike made at a center area of the electronic drum pad 1. The center sensor 150D should be a piezoelectric device, for example. Since the center-sensor assembly 150 includes the plate 150A, vibrations generated in the tray 145 are easily transferred to the plate 150A irrespective of its position. Therefore, compared with a case in which the center sensor 150D is bonded directly to the tray 145, the center sensor 150D can respond to a larger region in the tray 145. In addition, since the hole 150A-1 is provided for the plate 150A and the center sensor 150D is bonded to the position different from that of the hole 150A-1, strain (noise) caused at a center of the tray 145 is prevented from being picked up.

Double-sided adhesive tape (double-sided adhesive sheets) or other parts may be used, if necessary, to bond the sheets or members described above to adjacent sheets or members.

Relationship with a WaveDrum System

A WaveDrum system detects the ratio between high-pitched sound generated when a peripheral area or rim of an electronic drum is struck and low-pitched sound generated when a center area thereof is struck, estimates the position of a strike on the basis of the ratio, simulates a tone on the basis of the estimated position of the strike, and generates sound of the simulated tone. To use the WaveDrum system, an electronic drum needs to be structured such that the ratio between high-pitched sound generated at a peripheral area of the electronic drum and low-pitched sound generated at a center area thereof changes continuously as the position of a strike changes.

Figures 4A, 4B:
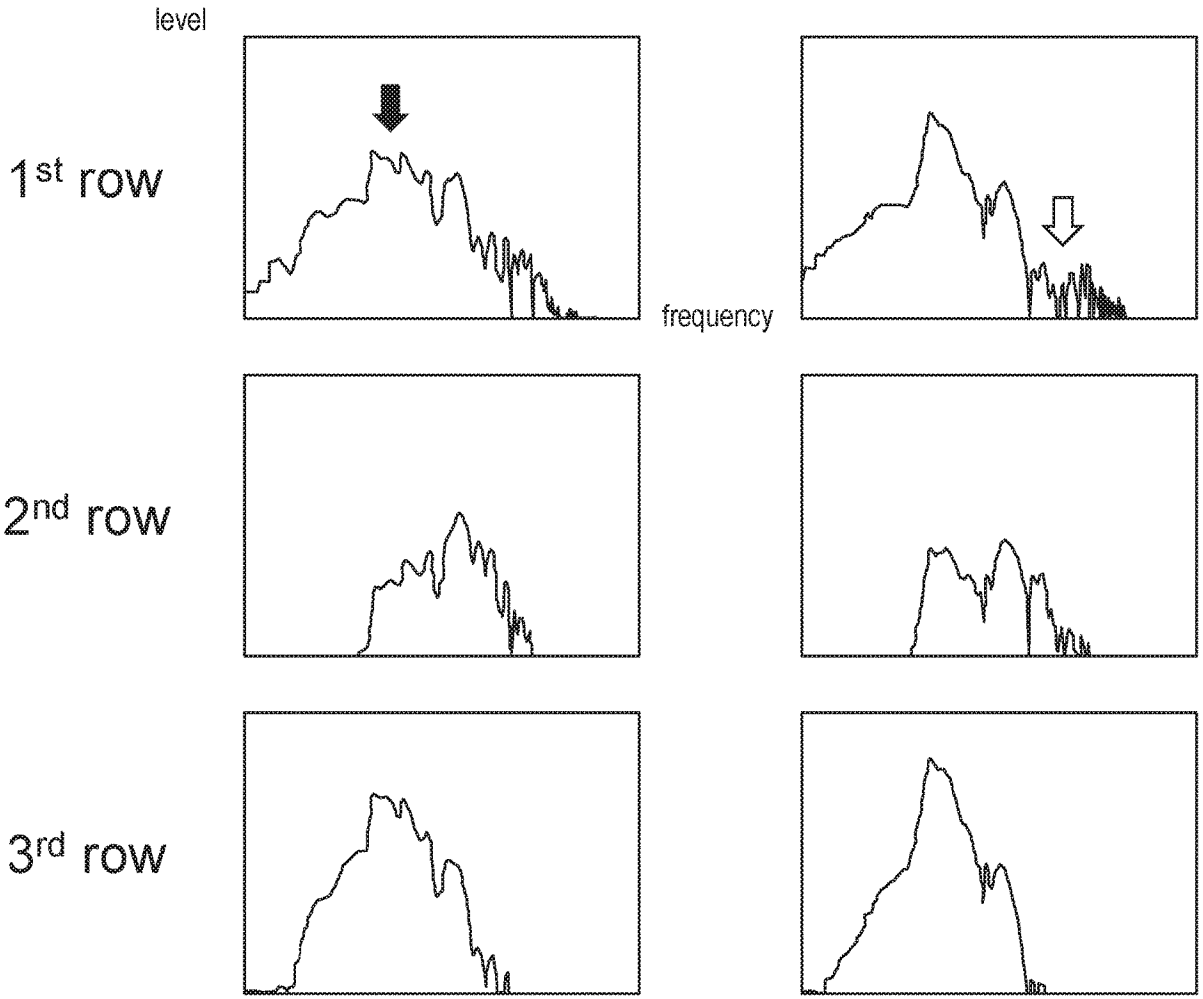
FIG. 4A and FIG. 4B show example graphs of frequency components of signals input to sensors when the head of the electronic drum pad according to the first embodiment is struck.

As described above, in the present embodiment, since the first hard-resin sheet 105 is made of a hard resin and further, is disposed at the uppermost layer in the internal structure, high-pitched sound is generated when a peripheral area of the head is struck with a stick, and the ratio of high-pitched sound becomes smaller continuously and the ratio of low-pitched sound becomes larger continuously as the position of a strike approaches a center area of the head. FIG. 4A and FIG. 4B show example graphs showing frequency components of the signal obtained by adding two signals input to the edge sensor 130B and the center sensor 150D when the head is struck. Graphs in FIG. 4A show waveforms of the input signals generated when a peripheral area of the head is struck, and graphs in FIG. 4B show waveforms of the input signals generated when a center area of the head is struck. Graphs in the first row show frequency components of input signals; graphs in the second row show high-frequency components of signals passing through a high-pass filter; and graphs in the third row show low-frequency components of signals passing through a low-pass filter. When the graph in the first row in FIG. 4A and the graph in the first row in FIG. 4B are compared, it is found that, in the signals obtained when a peripheral area of the head is struck, peaks in the low-frequency region to the intermediate-frequency region, observed when a center area of the head is struck are reduced (see a black arrow in the graph). It is also found that, in the signals obtained when a center area of the head is struck, peaks in the high-frequency region, observed when a peripheral area of the head is struck are reduced (see a white arrow in the graph). From the graphs in the second row and the third row, it is also found that the above-described features are maintained even after high-frequency transmission and low-frequency transmission caused by the filters. Therefore, the ratio between high-pitched sound generated when the rim is struck and low-pitched sound generated with the center area is struck can be detected successfully.

In addition, since the cloth 110 serves as the second layer in the internal structure, noise caused when the first hard-resin sheet 105 and the porous resin sheet 115 hit each other can be canceled out. Therefore, the tone of sound can be simulated at higher precision by the use of the WaveDrum system.

Second Embodiment

Figure 5A:
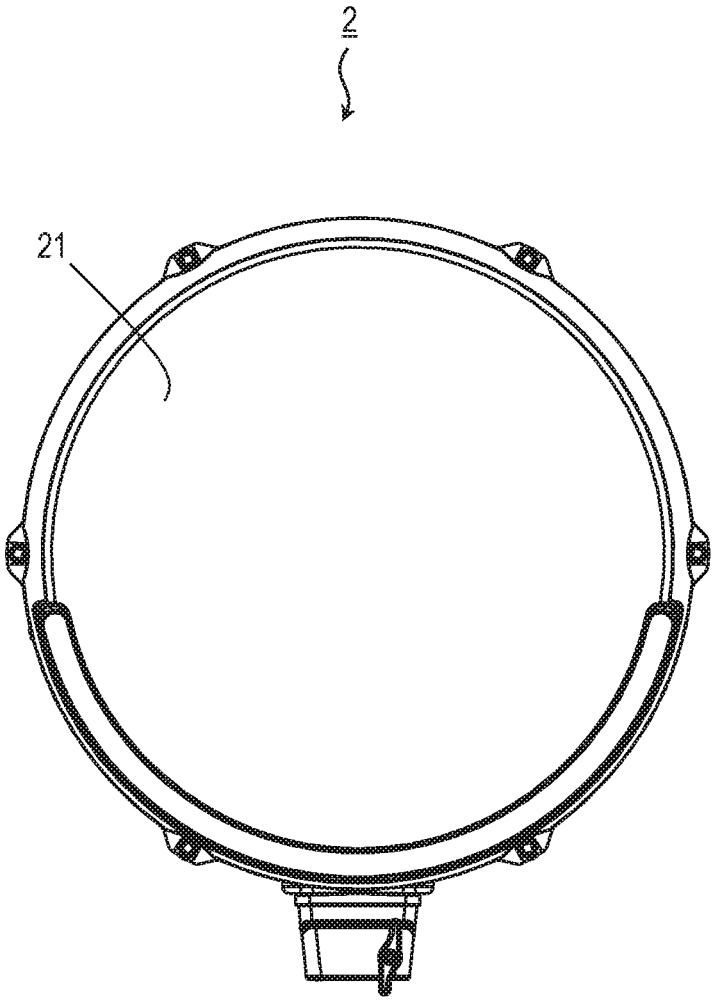
FIG. 5A and FIG. 5B are views showing an electronic drum pad according to a second embodiment.
Figure 5B:
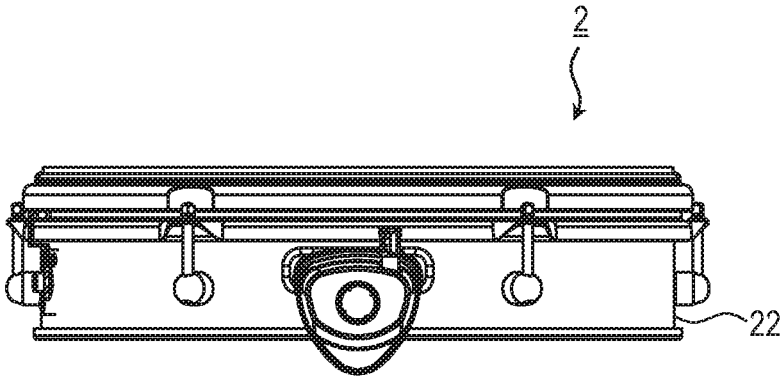

The external shape of an electronic drum pad 2 according to a second embodiment will be described below by referring to FIG. 5A and FIG. 5B. The electronic drum pad 2 of the present embodiment imitates a tom-tom. As shown in the figures, the electronic drum pad 2 is shallow and almost cylindrical and includes a drum shell 22 having an upper opening and a lower opening and a mesh head 21 stretched at the upper opening of the drum shell 22.

Figure 6:
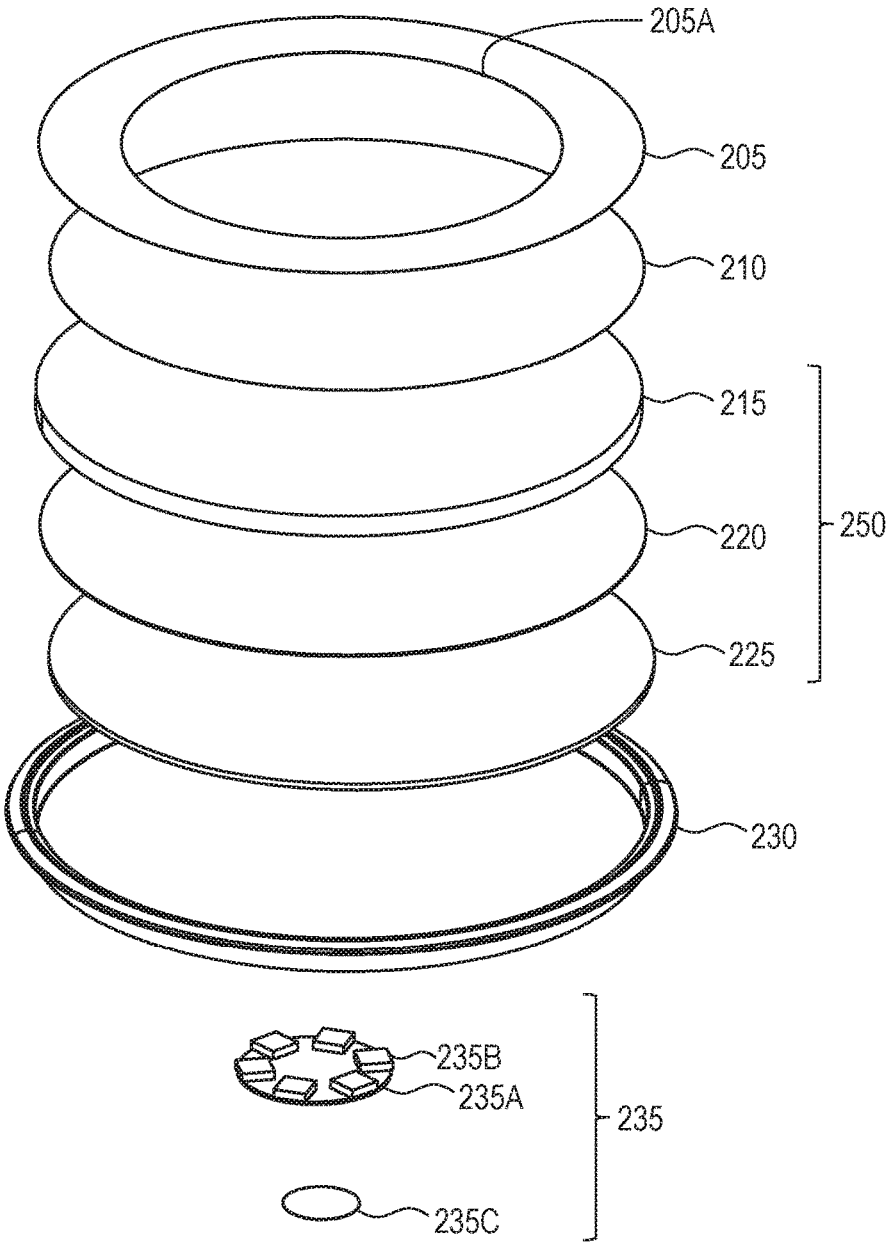
FIG. 6 is an exploded, perspective view of the parts other than a mesh head and a drum shell in the electronic drum pad according to the second embodiment.
Figure 7:
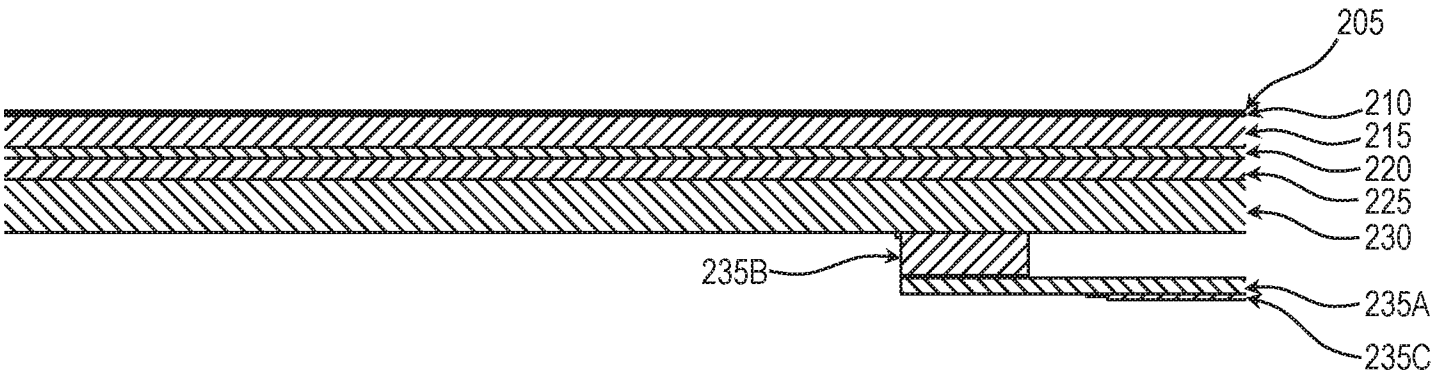
FIG. 7 is an outline cross-sectional view of the electronic drum pad according to the second embodiment.

The internal structure of the electronic drum pad 2 according to the present embodiment will be described below by referring to FIG. 6 and FIG. 7. As shown in FIG. 6 and FIG. 7, the electronic drum pad 2 internally includes a hard-resin sheet 205 having a circular, thin, ring shape, disposed adjacent to the rear surface of the mesh head 21, and having an opening 205A at a center thereof; a cloth 210 disposed adjacent to the rear surface of the hard-resin sheet 205; a strike absorbing member 250 disposed adjacent to the rear surface of the cloth 210 and formed by overlaying a plurality of sheets (215, 220, and 225); a tray 230 disposed adjacent to the rear surface of the strike absorbing member 250 and fitted into the lower opening of the drum shell 22; and a center-sensor assembly 235 secured to the rear surface of the tray 230.

Hard-Resin Sheet 205

The hard-resin sheet 205 is made of the same material as the first hard-resin sheet 105 used in the first embodiment. A cut at the opening is not made here.

Cloth 210

The cloth 210 is made of the same material as the cloth 110 used in the first embodiment. A cut is not made here because an edge-sensor assembly is not used in the electronic drum pad 2.

Strike Absorbing Member 250

The strike absorbing member 250 is made of the same materials as the strike absorbing member 170 used in the first embodiment, and is made by overlaying, sequentially from the mesh head 21, a porous resin sheet 215, a rubber sheet 220, and a resin emulsion sheet 225.

Porous Resin Sheet 215

The porous resin sheet 215 is made of the same material as the porous resin sheet 115 used in the first embodiment. A cut is not made here.

Rubber Sheet 220

The rubber sheet 220 is made of the same material as the first rubber sheet 135 used in the first embodiment. A cut is not made here.

Resin Emulsion Sheet 225

The resin emulsion sheet 225 is made of the same material as the resin emulsion sheet 140 used in the first embodiment. A cut is not made here.

Center-Sensor Assembly 235

The center-sensor assembly 235 is made of the same materials as the center-sensor assembly 150 used in the first embodiment. A plate 235A does not have a hole, and the center-sensor assembly 235 has a more simplified structure than the center-sensor assembly 50 used in the first embodiment. The center-sensor assembly 235 is secured to a position slightly shifted from the center of the rear surface of a tray 230 in order to detect, with a good balance, a signal made by a strike.

What is claimed is:

1. An electronic drum pad comprising:

a drum shell;

a mesh head stretched at an upper opening of the drum shell;

a hard-resin sheet disposed adjacent to a rear surface of the mesh head and having a ring shape with an opening made at a center thereof;

a cloth disposed adjacent to a rear surface of the hard-resin sheet;

a strike absorbing member disposed adjacent to a rear surface of the cloth and formed by overlaying a plurality of sheets; and a tray disposed adjacent to a rear surface of the strike absorbing member and fitted into a lower opening of the drum shell.

2. The electronic drum pad according to claim 1, wherein the plurality of sheets comprise at least, in the following order, a porous resin sheet, a rubber sheet, and a resin emulsion sheet.

3. The electronic drum pad according to claim 2, further comprising:

a second hard-resin sheet and a second rubber sheet both sandwiched between the porous resin sheet and the rubber sheet;

wherein the second hard-resin sheet and the second rubber sheet are formed smaller than the opening of the hard-resin sheet and are disposed at positions such that shapes made by projecting the second hard-resin sheet and the second rubber sheet from above are included in a shape made by projecting the opening of the hard-resin sheet from above.

4. The electronic drum pad according to claim 1, further comprising an edge-sensor assembly disposed at a position close to an inner wall of the drum shell, wherein the edge-sensor assembly comprises:

a first cushion member contacting with the rear surface of the hard-resin sheet;

an edge sensor contacting with a rear surface of the first cushion member;

a second cushion member contacting with a rear surface of the edge sensor; and a pedestal contacting with a rear surface of the second cushion member and connecting to a front surface of the tray.

5. The electronic drum pad according to claim 2, further comprising an edge-sensor assembly disposed at a position close to an inner wall of the drum shell, wherein the edge-sensor assembly comprises:

a first cushion member contacting with the rear surface of the hard-resin sheet;

an edge sensor contacting with a rear surface of the first cushion member;

a second cushion member contacting with a rear surface of the edge sensor; and a pedestal contacting with a rear surface of the second cushion member and connecting to a front surface of the tray.

6. The electronic drum pad according to claim 3, further comprising an edge-sensor assembly disposed at a position close to an inner wall of the drum shell, wherein the edge-sensor assembly comprises:

a first cushion member contacting with the rear surface of the hard-resin sheet;

an edge sensor contacting with a rear surface of the first cushion member;

a second cushion member contacting with a rear surface of the edge sensor; and a pedestal contacting with a rear surface of the second cushion member and connecting to a front surface of the tray.

7. The electronic drum pad according to claim 1, further comprising:

a plate bonded to a center of a rear surface of the tray; and a center sensor bonded to a rear surface of the plate.

8. The electronic drum pad according to claim 2, further comprising:

a plate bonded to a center of a rear surface of the tray; and a center sensor bonded to a rear surface of the plate.

9. The electronic drum pad according to claim 3, further comprising:

a plate bonded to a center of a rear surface of the tray; and a center sensor bonded to a rear surface of the plate.

10. The electronic drum pad according to claim 4, further comprising:

a plate bonded to a center of a rear surface of the tray; and a center sensor bonded to a rear surface of the plate.

11. The electronic drum pad according to claim 7, wherein the plate has a ring shape with a hole made at a center thereof; and the center sensor is bonded to the rear surface of the plate so as not to overlap with the hole.

12. The electronic drum pad according to claim 8, wherein the plate has a ring shape with a hole made at a center thereof; and the center sensor is bonded to the rear surface of the plate so as not to overlap with the hole.

13. The electronic drum pad according to claim 9, wherein the plate has a ring shape with a hole made at a center thereof; and the center sensor is bonded to the rear surface of the plate so as not to overlap with the hole.

14. The electronic drum pad according to claim 10, wherein the plate has a ring shape with a hole made at a center thereof; and the center sensor is bonded to the rear surface of the plate so as not to overlap with the hole.

* * * * *